US005316642A

United States Patent [19]

Young, Jr. et al.

[11] Patent Number: 5,316,642

[45] Date of Patent: May 31, 1994

[54] OSCILLATION DEVICE FOR PLATING SYSTEM

[75] Inventors: David J. Young, Jr., Phoenix; Scott L. Randall, Mesa; Scott D. Shaw, Chandler; Andrew F. Wylde, Tempe, all of Ariz.

[73] Assignee: Digital Equipment Corporation, Maynard, Mass.

[21] Appl. No.: 52,496

[22] Filed: Apr. 22, 1993

[51] Int. Cl.[5] ..... C25D 17/06; C25D 17/16; C25D 21/06; C25D 21/10

[52] U.S. Cl. ..... 204/198; 204/222; 204/240; 204/212; 204/284; 204/297 R; 204/297 W; 204/DIG. 5

[58] Field of Search ..... 204/222, 297 R, 297 W, 204/240, 212, 198, DIG. 7, 297 M, DIG. 5, 199; 205/137, 146

[56] References Cited

U.S. PATENT DOCUMENTS

| | | | |
|---|---|---|---|
| 2,746,732 | 5/1956 | Guillette | 204/222 X |
| 3,065,105 | 11/1962 | Pohm | 117/93 |
| 3,141,837 | 7/1964 | Edelman | 204/43 |
| 4,720,329 | 1/1988 | Sirbola | 204/23 |
| 4,775,454 | 10/1988 | Urquhart et al. | 204/222 X |
| 4,816,119 | 3/1989 | Rauch et al. | 204/29 |
| 4,822,467 | 4/1989 | Young et al. | 204/212 |
| 4,990,225 | 2/1991 | Omata | 204/44 |
| 5,167,779 | 12/1992 | Henig | 204/222 X |

FOREIGN PATENT DOCUMENTS

| | | | |
|---|---|---|---|
| 337438 | 11/1970 | U.S.S.R. | 204/222 |

*Primary Examiner*—Donald R. Valentine
*Attorney, Agent, or Firm*—Albert P. Cefalo; Ronald C. Hudgens

[57] ABSTRACT

A method of and an apparatus for the electroplating of material onto substrates, such as computer memory disks, by use of a plating cell comprising cathodes, anodes, passive shields, filters, an oscillation system and an electrical power supply. Anodes and magnets are attached to the inside side walls of the plating cell. The magnets have a coating of an electrically non-conducting material covering it. Shields, each having a filter attached to it, are also fixed to the inside side walls. A pallet, having openings for holding disk substrates during electroplating, is placed between the shields in the plating cell. The disk substrates function as cathodes during electrolytic plating. The anodes and cathodes when electrically energized results in deposition of desired material, having uniform thickness, across the entire surface area of the substrate. The shields and the coated magnets function as current shields that control the flow of ions within the plating cell and thereby ensure uniformity of plating thickness at the substrate surface. The magnet also provides a radial flux pattern at the surface of the substrate to orient the deposit on the substrate surface. The oscillation system aids in attaining plating uniformity by ensuring a uniform replenishment of ions at the substrate surface. The pallet and the plating cell designs enable a large number of substrates to be electroplated simultaneously, thereby reducing the cost of plating the substrates.

4 Claims, 13 Drawing Sheets

OSCILLATION DEVICE FOR PLATING SYSTEM

BACKGROUND OF THE INVENTION

Magnetic disks are used in computer systems as the primary means of storing data. Conventional methods of data storage on disks use the process of longitudinal magnetic recording. Disks used with such a process consist of a layer of a high coercivity 'hard' magnetic layer, such as a cobalt based alloy, that is directly deposited onto a conductive substrate base. A more recent method utilized to increase the storage density of magnetic disks uses perpendicular or vertical magnetic recording. The use of such process requires a film of low coercivity 'soft' magnetic material, such as permalloy a Nickel - Iron (NiFe) alloy, to be deposited onto a disk substrate. Over this permalloy layer is deposited a vertically or perpendicularly oriented 'hard' magnetic data storage layer that can be magnetically influenced to record information, commonly encoded in digital (binary) form. The permalloy layer effectively functions as a part of the recording head beneath the vertically oriented hard magnetic layer, providing a magnetic return path which decreases the magnetic reluctance for the head. The coating of permalloy magnetic material and the hard magnetic material on the disk substrate is often done by the process of electroplating or electrodeposition.

The distribution of permalloy magnetic material should be of uniform thickness over the entire surface of the disk substrate. This is necessary in order to meet minimum plating thickness requirements, to reduce post-plating surface finishing activities and to attain high quality information recording at low noise levels. Further, by achieving uniform coating thickness, the amount of material that has to be removed by post-plating surface finishing processes is reduced, thereby minimizing the total amount of plated material consumed. Commonly used methods of cathode robbing or thieving for removing excess plated material are inefficient. Then too, by ensuring a uniform thickness of plated material on a disk substrate surface, surface flatness is achieved and the surface flatness of disk substrates is a key performance criteria. A flat surface results in efficient functioning of the disk substrate and head assembly by minimizing the mechanical acceleration forces required for the head to follow the disk as it spins.

In order to achieve uniform plating distribution there must exist uniform current distribution at the surface of the disk substrate during electroplating. Prior art processes have not been very effective in controlling plating uniformity over the entire surface, especially at the outer and inner edges, of the disk substrate. Accordingly, there always exists a need for an apparatus that ensures the establishment of uniform current distribution across the entire surface of the disk substrate, to facilitate the uniform deposition of magnetic material during electroplating.

The permalloy magnetic material must also be magnetically oriented, in generally the same preferred circumferential direction, when deposited on the surface of the disk substrate for optimum disk performance. The magnetic orientation of the deposit results in greater magnetic permeability (permeance ratios $>2.0$) of the deposit in the preferred circumferential direction compared to the radial direction. Such a preferentially oriented magnetic deposit is less sensitive to stray magnetic fields and therefore produces less noise in the recording system.

Therefore there must be a source of magnetic flux to orient the magnetic material at the time of deposition of the coating material on the disk substrate. Prior art electroplating processes have used large electromagnets or large permanent magnets, placed outside the plating tank, as a source for magnetic flux for the orientation of the particles. U.S. Pat. No. 3,141,837, issued to Edelman, discloses one of the prior art methods for electrodepositing nickel iron alloys on a substrate. The Edelman method uses a permanent magnet positioned around the outside of the tank to provide an orienting magnetic field to the alloy to be electrodeposited. Due to the large size and the distant positioning of the magnets, the previous processes have not been able to provide small localized areas of magnetic flux. This results in only a limited number of disk substrates that can be electroplated at any one time while achieving both acceptable plating uniformity and magnetic orientation. Moreover, the prior art methods, as described above, are relatively expensive, due to the size of the magnets. Also, due to the inefficient conductance of flux energy, existing substrate plating systems have the capability of plating only a few substrates at a time. U.S. Pat. No. 4,720,329, issued to Sirbola being an example of one such method. Therefore, there exists a need for cheaper and more efficient and effective electroplating processes for disk substrates, suitable for mass commercial production.

The previous processes also experienced the problem of "plate-up" of substrate holders. The substrate holders have to be stripped to remove the plated material before re-use thereby making the process costly and inefficient.

The electroplating process deposits magnetic material on the disk substrate surface by the reduction of metal ions with electrons at the disk substrate surface. This results in ion depletion in the electroplating solution in the immediate vicinity of the disk substrate. Ion depletion leads to a non-uniform electroplating rate, causing both non-uniform plating thickness and non-uniform concentration of ions in the deposited magnetic material. Ion depletion can be corrected by replenishing ions at the cathode surface during electroplating by the mass transport of ions to the disk substrate surface, using mechanical agitation methods to stir up the electroplating liquid. The commonly used 'knife-edge' methods of horizontal or vertical motion of disk substrates results in the preferential replenishment of ions and thereby non-uniform plating along the leading edges of the substrate, perpendicular to the direction of travel.

Also, generally fixed magnets are used to align the deposited magnetic material. However, by using a vertical or horizontal 'knife-edge' agitation method for moving the disk substrates, the radial magnetic field cannot be maintained when fixed magnets are used. As a result, the orientation of the deposited magnetic material tend to be uniform in the direction of 'knife-edge' movement, but variable in the perpendicular direction.

SUMMARY OF INVENTION

The present invention is a method and an apparatus for the electroplating of disk substrates that overcomes prior art problems of non-uniformity of plating thickness and concentration and of low volume of disk substrates that could be plated at one time, while achieving improved plating uniformity and concentration, and uniform magnetic orientation.

An object of the invention is the production of a higher performance magnetic disk having high storage density.

Another object of the invention is the production of a reduced cost magnetic disk.

These and other objects are attained, in a broad sense, through the use of various features of the invention. One feature of the invention is an anode-magnet arrangement, where the anode has an opening in it's central region and is positioned in a spaced apart relationship to a disk holder. In order to achieve magnetic orientation of the plated layer on the disk substrate, magnets are used. The magnets and the anodes are specially configured to minimize the space required between disk substrates. The magnets extend through the opening in each anode into the cell. The magnets produce radial magnetic flux patterns at the surface of the substrate effective to orient the magnetic material as it is deposited on the surface of the disk substrate.

By utilizing a design that allows the magnets to extend through the anodes, the necessity to place magnets behind the anodes is eliminated. Placing magnets behind anodes (typically in the exterior wall of the plating tank) results in reduced flux flow to the surface of the disk substrate to be plated. It also requires the use of very strong electromagnets or very large and powerful permanent magnets to generate the required magnetic field. Large permanent magnets and electromagnets are very expensive. Therefore, the anode-magnet arrangement used in this invention results in cost and space efficiencies while enabling controlled deposition of material on the disk substrate.

One of the primary factors influencing plating distribution is the distribution of current across the surface of the disk substrate to be plated. Current distribution must be uniform, for plating distribution to be uniform. Current distribution can be made uniform by establishing uniform ohmic potential across the surface of the disk. This invention uses insulators acting as current shields to control the uniformity of ohmic potential.

The magnets are coated with an insulating material to allow the magnets to function as current shields, thereby, promoting uniform current distribution through the cell and thereby resulting in uniform plating thickness towards the central region of the substrate.

Another feature of the invention is an electrically non-conducting member, mounted between the holder and the anode, that functions as a current shield. The shield has openings that are positioned and sized with respect to the movement of ions, from the anode to the disk substrate during electroplating, and with the respect to the position and size of the substrate held at the opening, so as to promote a uniform thickness of plating material across the surface of the member. Attached to the shield and covering the opening on the shield is a filter. The filter used in conjunction with the shield to prevent unwanted matter from electroplating fluid, such as anode particles and sludge moving between the anode and substrate during electroplating from reaching the substrate surface during plating.

Yet another feature of the invention is the use of an oscillation technique to produce relative motion between the liquid and the disk substrate to promote a uniform thickness of plating material over the entire surface of disk substrate, including the outer boundary. Since metal ion depletion occurs at the disk surface during electroplating, the replenishment of ions around the disk substrate surface is very important for deposit uniformity. The oscillation system used in this invention assists with the mass transport of ions to the disk substrate surface by providing controlled plating solution flow at the disk substrate surface, thereby maintaining a flow of fresh ions to the disk substrate surface. Therefore, the leading edge replenishment problem is eliminated. Further, since this embodiment incorporates fixed magnets and shields, using conventional agitation methods would not have preserved the radial magnetic field with respect to the center of the disk substrate; the use of an oscillation technique allows that to happen resulting in an uniform orientation of the magnetic material deposited.

Still another feature of the invention is a substrate holder assembly that doesn't 'plate-up'. The substrate holder or pallet has openings and is made of a current conducting base material that is coated with a non-conducting material such as plastic to prevent plating on its surface. The substrate holder assembly consists of a first supporting means having a groove for holding a disk substrate in the opening by supporting the disk substrate at its outer circumferential edge. The first supporting means is located at the opening and provides an electrical connection with the disk substrate through which it is electrically energized during electroplating. There exists also, a second supporting means that is located generally at opposite side of the opening from the first supporting means. The second supporting means applies a resilient force at the outer circumferential edge of the disk substrate to urge the disk substrate towards the first supporting means. The supporting means does not plate-up during the electroplating operation, thereby making it easier to adopt an automated substrate loading and unloading system while reducing maintenance and strip cycles.

It is an advantage of this invention that uniform plating distribution is achieved.

It is another advantage of this invention that a large number of disk substrates can be plated at the same time.

Yet another advantage of this invention is the compatibility for easy, automatic loading and unloading of disk substrates, resulting in increased throughput of the substrate plating process.

The foregoing and additional objects, features and advantages of the present invention will become apparent to those skilled in the art from a more detailed consideration of the preferred embodiment thereof, taken in conjunction with the accompanying drawings.

DETAILED DESCRIPTION OF THE INVENTION

Figure 1:
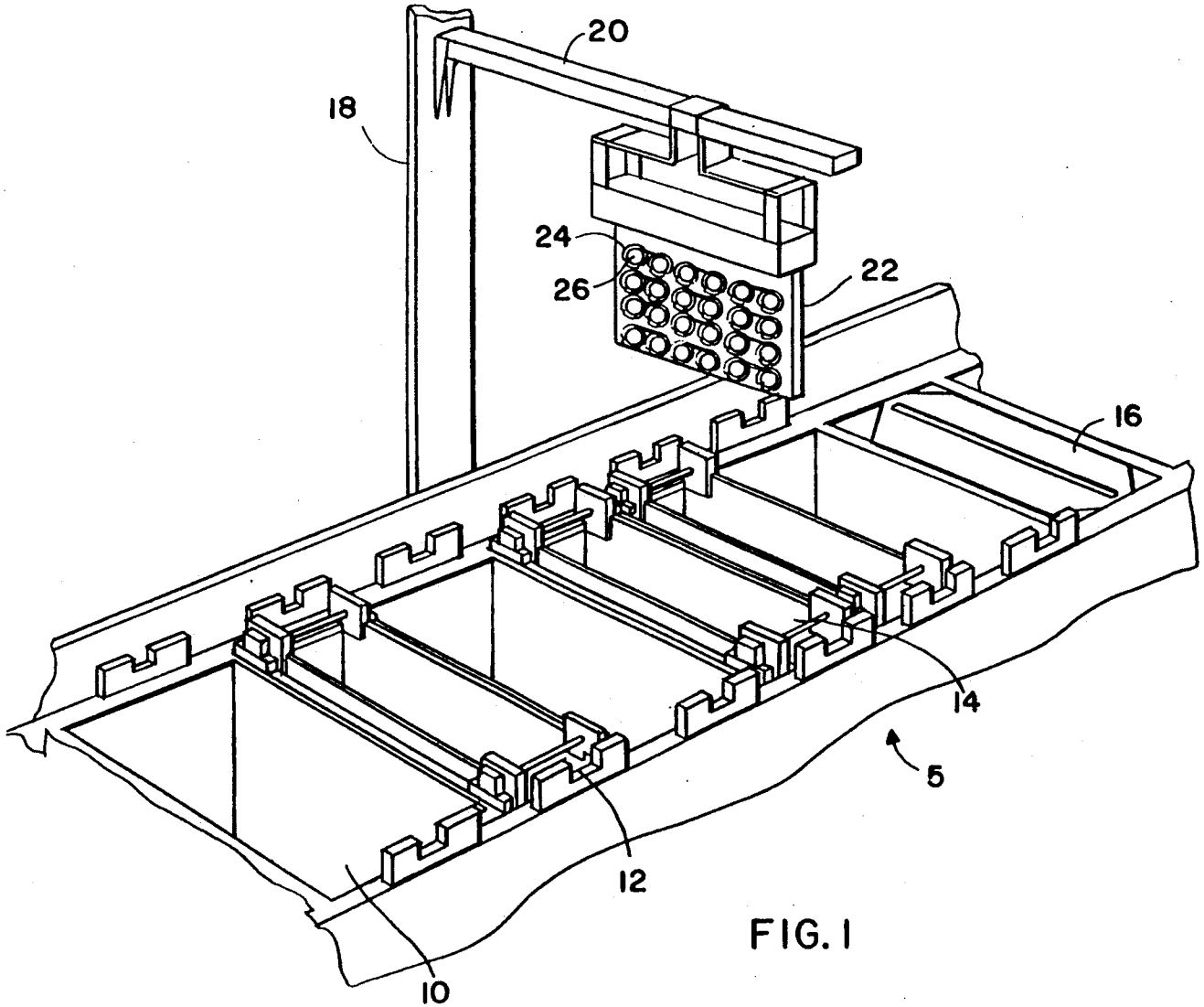
FIG. 1 is a perspective view of a portion of a plating line for electroplating disk substrates according to the principles of the invention. The figure shows the different stations incorporated in the line, a hoist, a work bar and a pallet.

There is illustrated in FIG. 1 a plating line generally indicated at 5 which incorporates a conventional cleaning station 12 to clean disk substrates 26 of contaminants, a rinse station 10 to fully rinse disk substrates 26, an activator station 14 to de-oxidize the fully rinsed disk substrates 26, and a plating station 16 to plate the disk substrates 26 with a desired material. The plating line 5 also incorporates a hoist 18, a work bar 20 and a pallet 22. The hoist 18 is capable of moving in both the horizontal and vertical directions. The hoist 18 is used to transport the pallet 22 from station to station. The pallet 22 is mounted on the work bar 20 which is itself attached to the hoist 18. The pallet has openings 24 in which are held the disk substrates 26. Stations 10, 12 and 14 prepares the disk substrates 26 for electroplating in the plating station 16.

Figure 4:
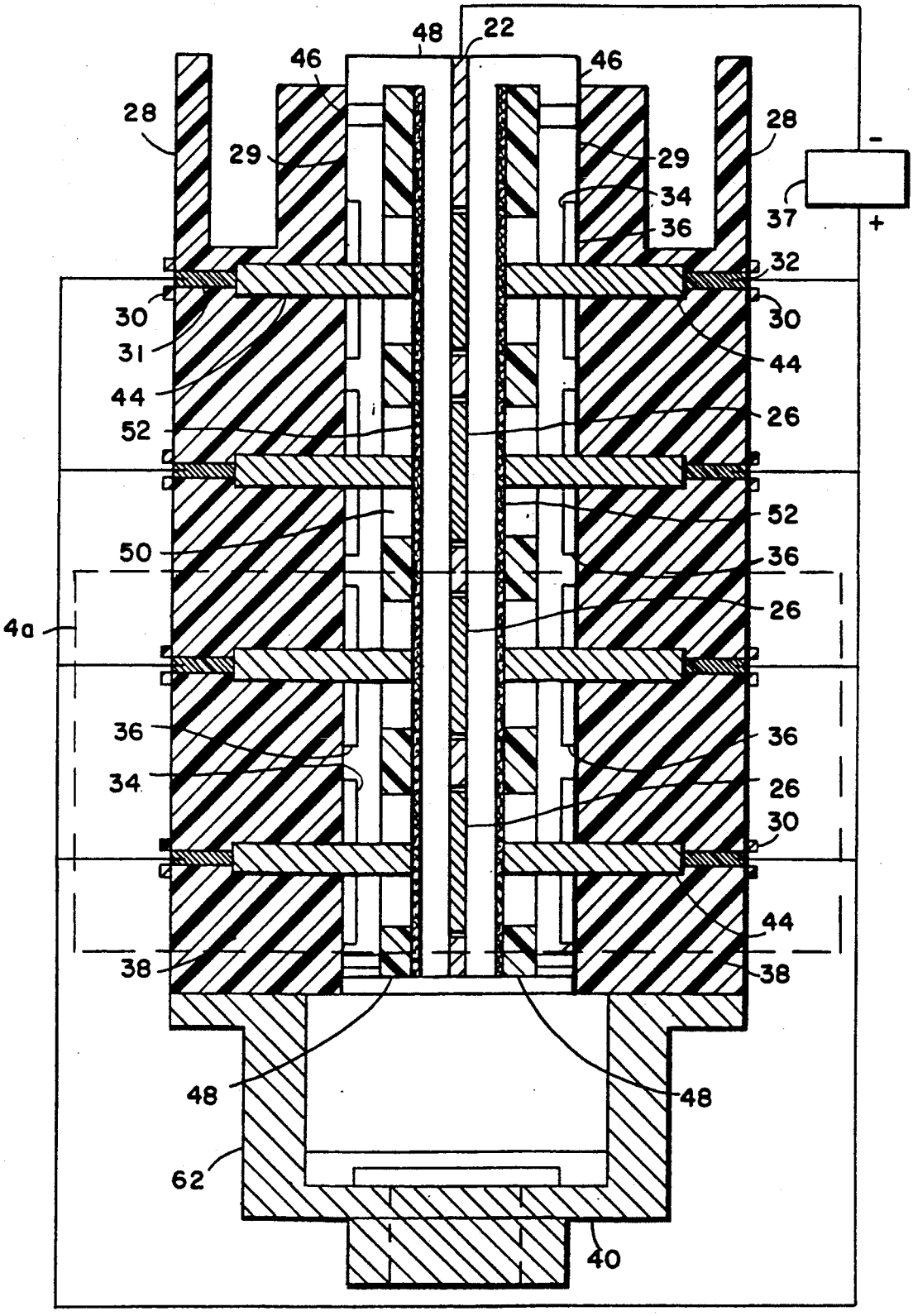
FIG. 4 is a side elevation view in section of the plating cell.
Figure 4A:
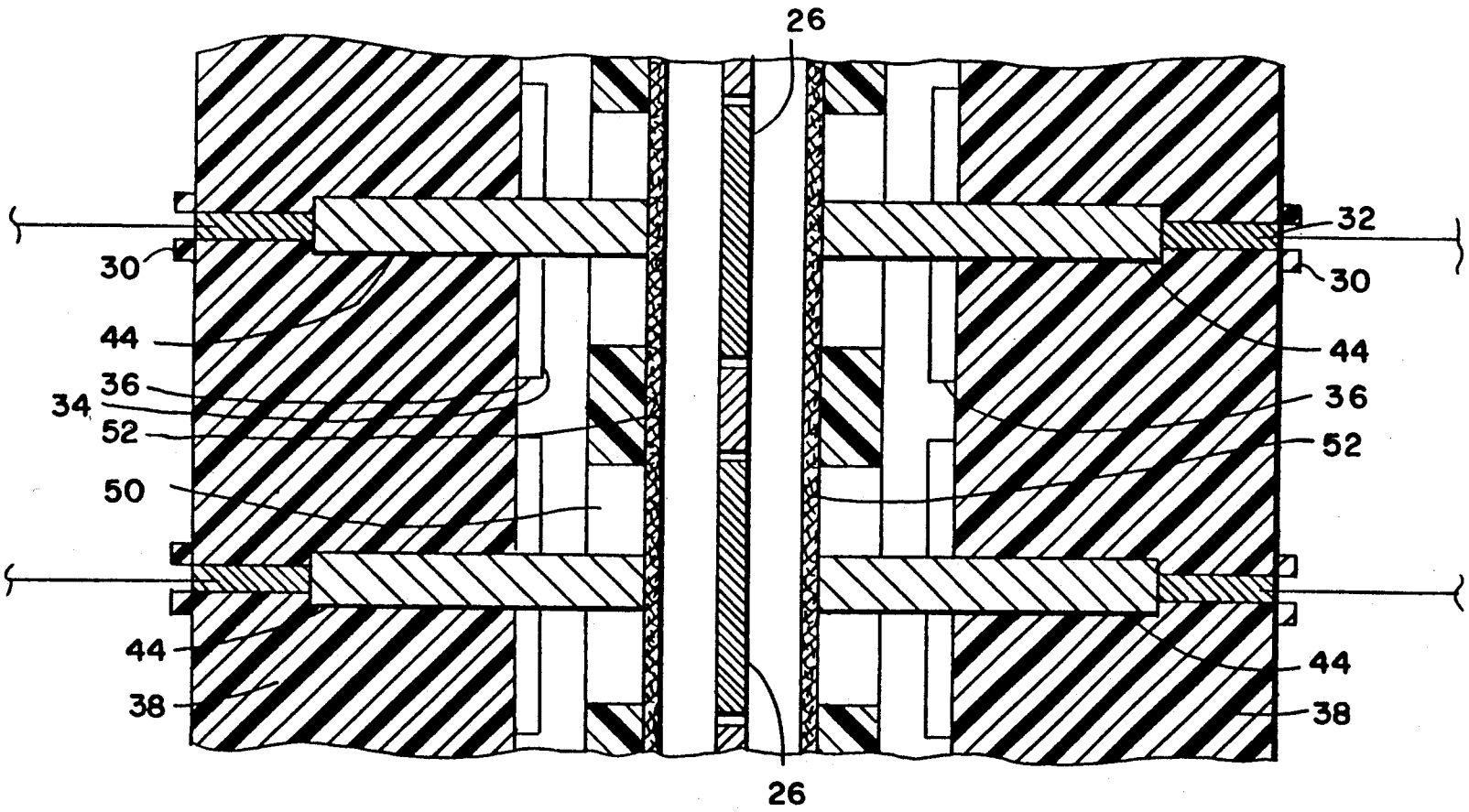
FIG. 4a is an exploded side elevation view in section of a part of the plating cell.
Figure 5:
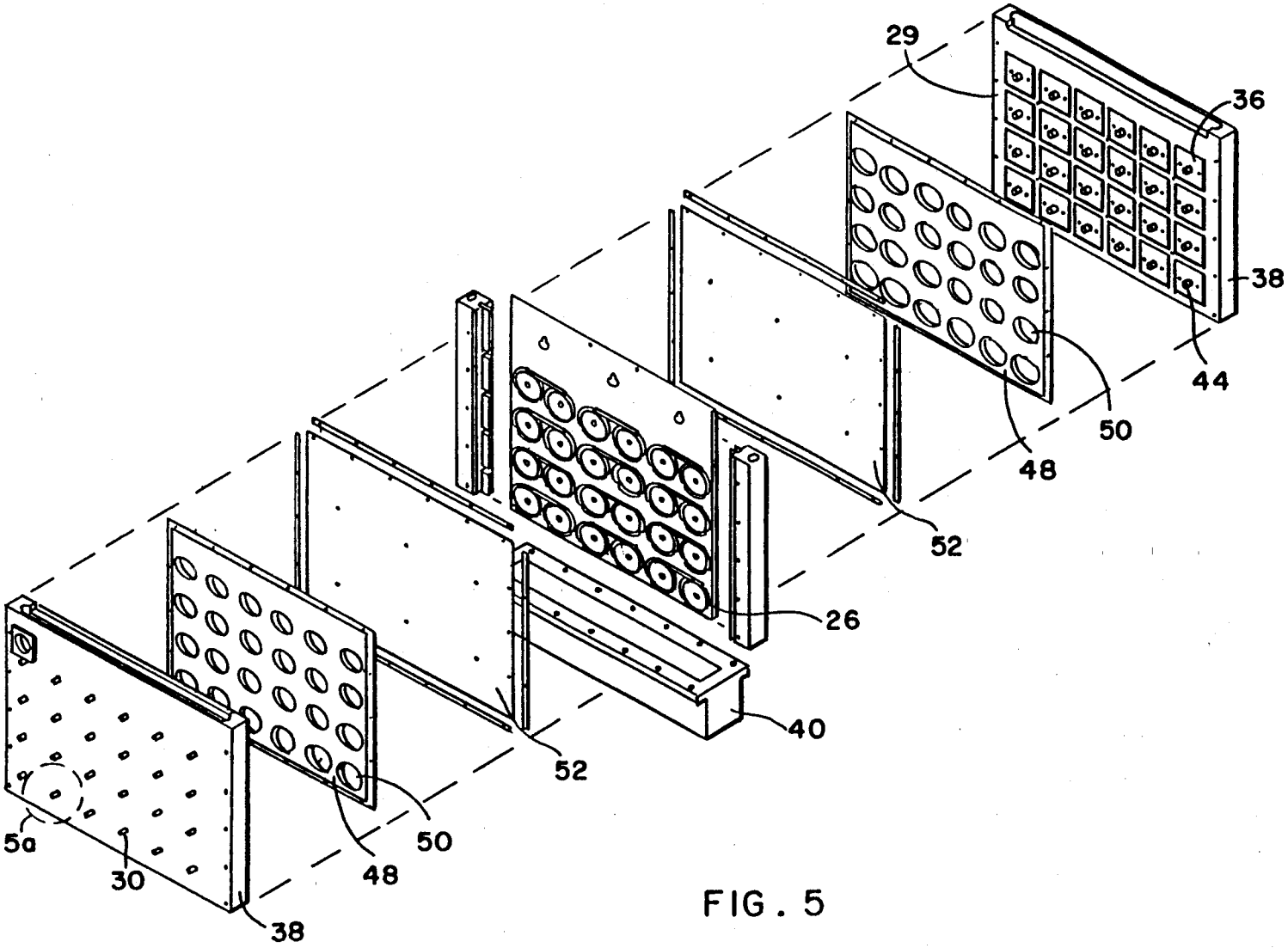
FIG. 5 is an exploded view of the plating cell shown in FIG 1, showing all the pieces that make up the plating cell.
Figure 5A:
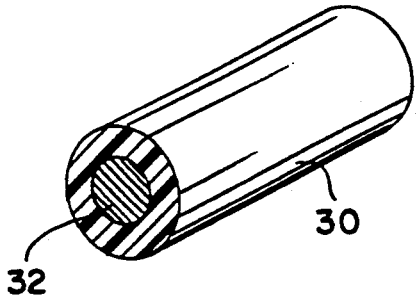
FIG. 5a is an exploded view of the collared opening on the outside surface of a side wall of the plating cell having an electrical contact lead inserted through it.
Figure 6A:
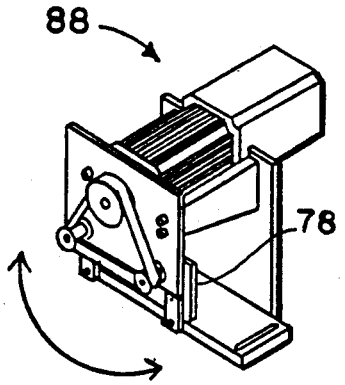
FIG. 6a is a perspective view showing the pallet oscillation mechanism.
Figure 6B:
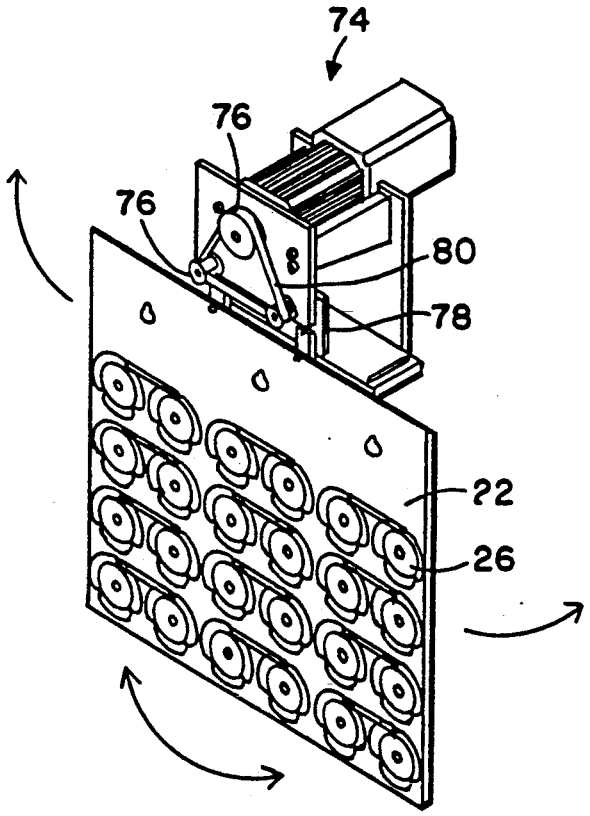
FIG. 6b is a perspective view showing the pallet oscillation mechanism with a pallet mounted on it.
Figure 6C:
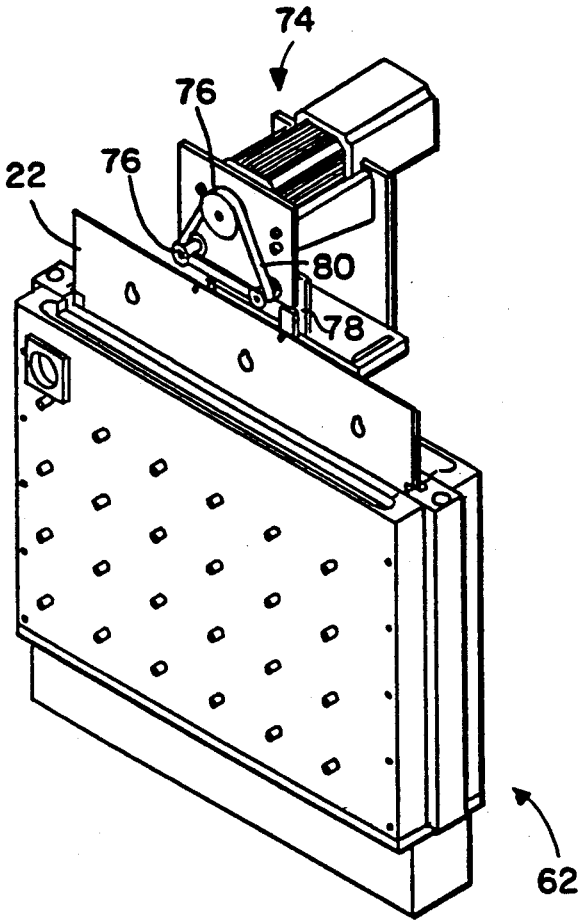
FIG. 6c is a perspective view showing the pallet oscillation mechanism with a pallet mounted on it and immersed in a plating cell.
Figure 6D:
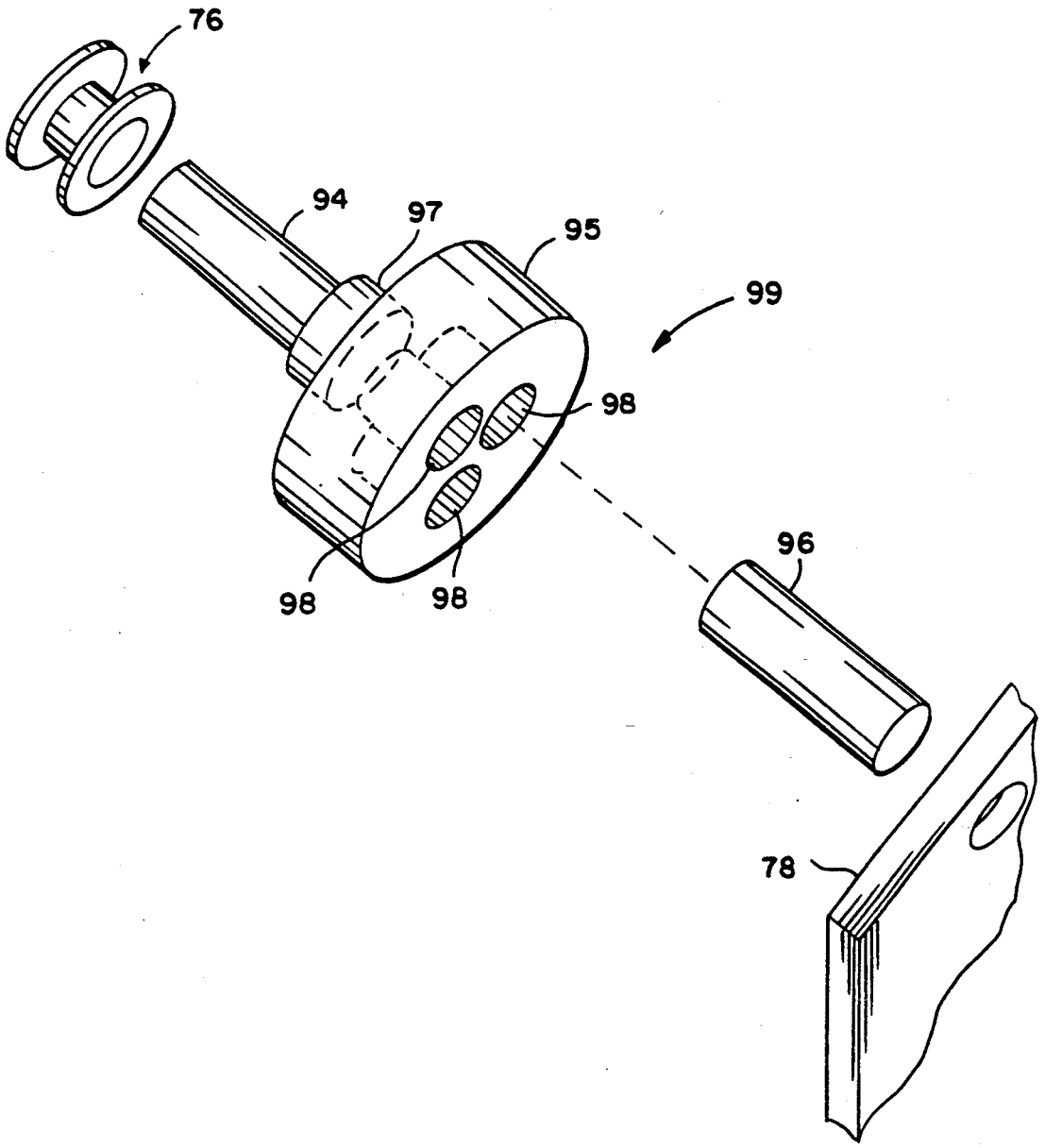
FIG. 6d is a perspective view showing the cam link mechanism that is used to transfer motion from the drive pulleys to the tooling plate.
Figure 7:
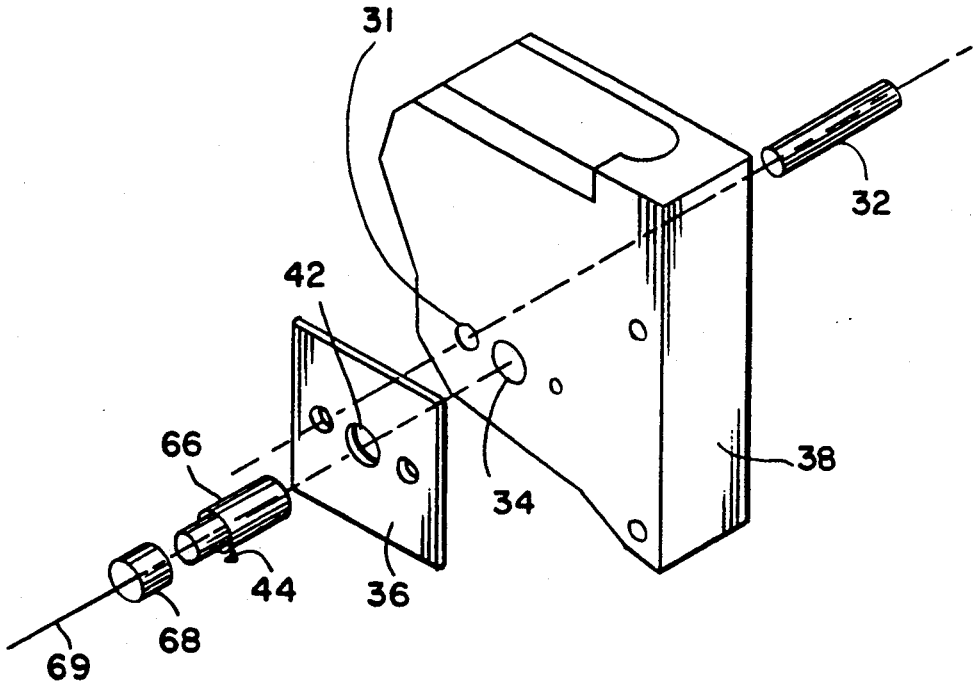
FIG. 7 is an enlarged exploded view of one of the anode and magnet assemblies shown in FIGS. 4, 4a and 5.

Referring to FIG. 4, 4a, 5, 5a, and 7, the plating station 16, where the substrates are electroplated with a film of low-coercivity magnetic material (such as permalloy), consists of plating cell 62 immersed in plating solution or electrolyte 64 contained in plating station 16. Plating cell 62 consists of two identical side walls 38, mounted on a bottom diffuser plate 40, aligned with each other. Each side wall 38 has an outside surface 28, that has a collared opening 30 that extends into a passageway 31 running through the wall 38, as shown in FIG. 5a. The collared opening 30 has an electrical contact lead 32 inserted through it. In this embodiment, the inside surface 29 of each side wall 38 has an anode 36 mounted on it. The anode 36 is electrically connected to the leads 32. Each of the anodes 36 has an opening 42 at its center that is generally aligned with one of the openings 34 in the inside surface 29. As shown, there are magnets 44 that extend from the opening 34 in the interior surface 29. A portion of the magnet 44 extends through the opening 42 in the anode 36. Each of the magnets 44 has a coating of an insulating material 66 that allows the magnet to function as a current shield during electroplating.

Attached to each side wall 38, by means of pegs 46, is a shield member 48. The two shields 48 have openings 50 that are generally aligned with the opening 42 in the anode 36. Attached to each shield 48 is a filter 52 that covers the openings 50 in each shield 48. The filter 52 removes unwanted matter from the plating solution 64 from passing through during electroplating.

The embodiment shown in FIGS. 1-9 is used to electroplate a permalloy nickel-iron (NiFe) layer onto a disk substrate 26. The disk substrate 26 is made of aluminum and as shown is 1.9 inches (48 mm) in diameter. Good electroplating results have been obtained by forming a layer, approximately 1-2 micron, of non-magnetic electroless nickel on the aluminum disk substrate 26 using a standard double-zincating preparation method and a high phosphorous electroless nickel deposition, prior to the permalloy electroplating process. Other desirable disk substrate types (e.g. glass, ceramic, etc.) may also be processed in the permalloy deposition process, if the disk substrate is properly prepared with a suitable metallic coating, prior to electroplating. The disk substrates would have to be catalyzed and subsequently metallized with metals like Copper (Cu), Nickel-Phosphorous (NiP), etc..

Figure 2:
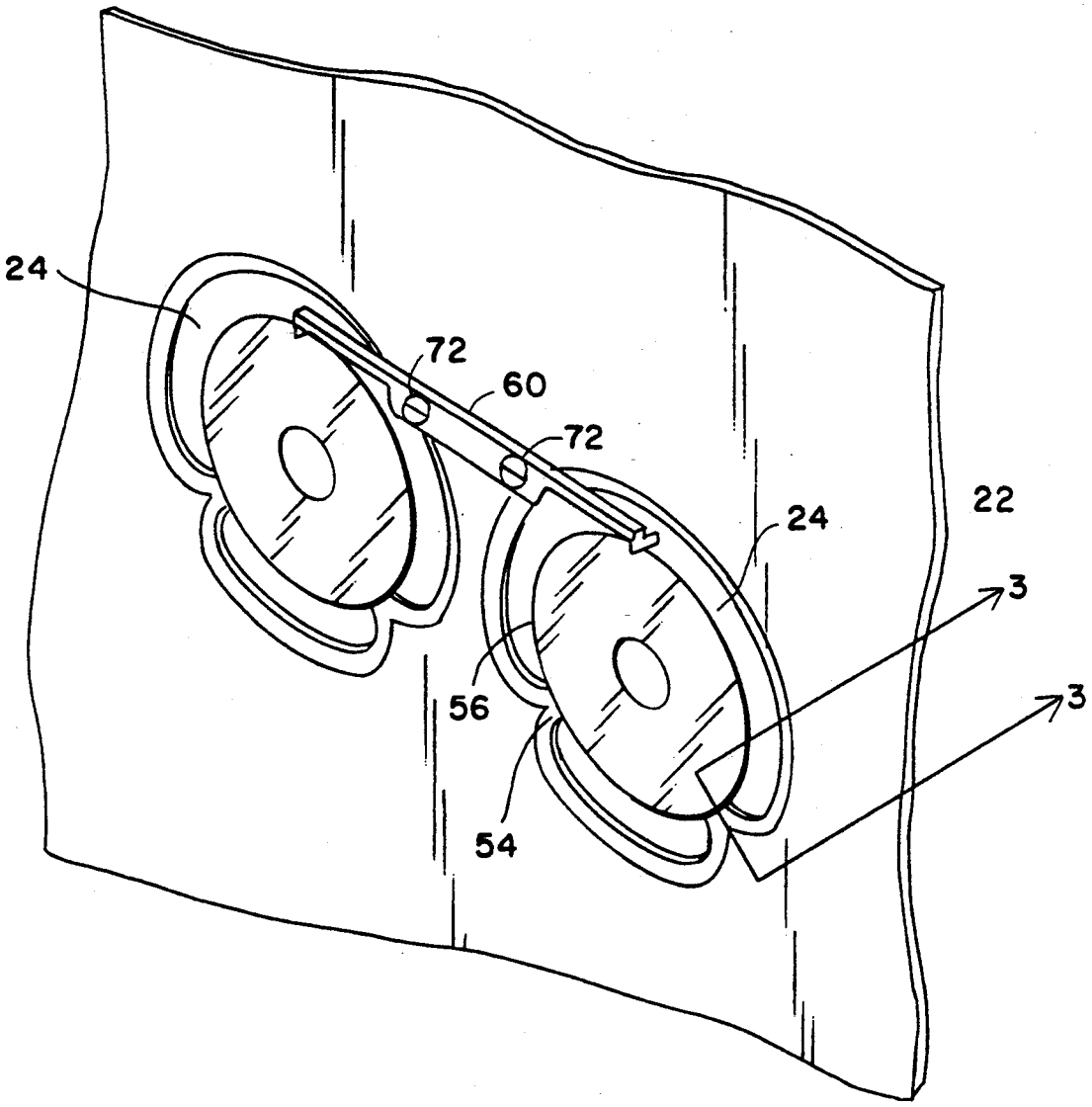
FIG. 2 is a front elevation view of a disk substrate to be electroplated mounted on the pallet shown in FIG. 1.
Figure 3C:
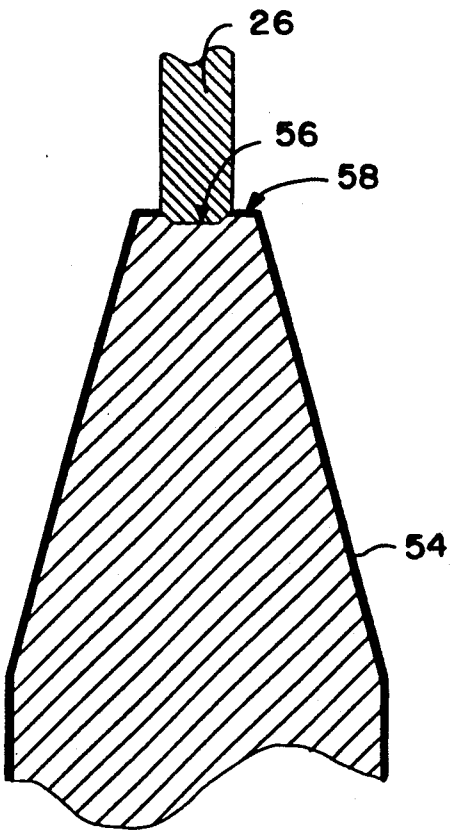
FIG. 3*b* and 3*c* are alternative shapes for holding means that may be used to hold the disk substrates in the disk holder opening.
Figure 3B:
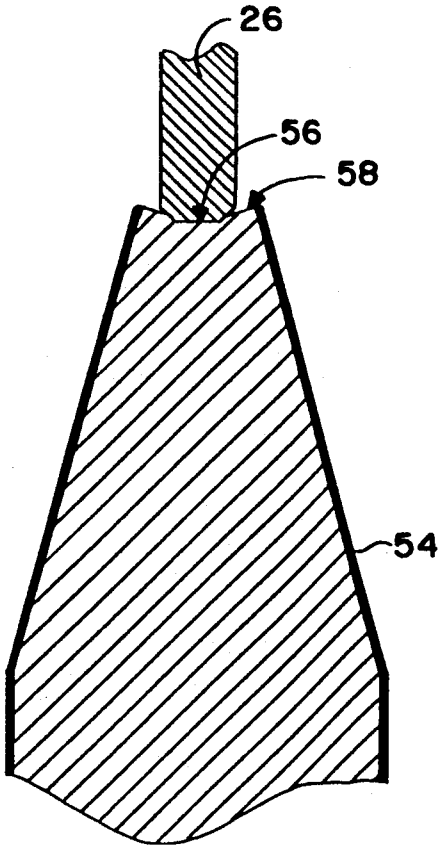
Figure 3A:
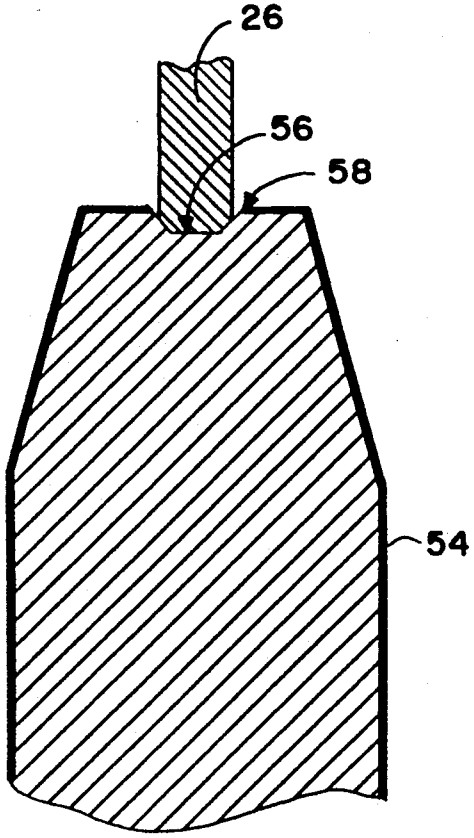
FIG. 3*a* is a close-up view in cross-section of one of the disk substrates shown in FIG. 2 mounted to rest on a contact edge surface defining one of the openings in the pallet shown in FIGS. 1 and 2.

After the disk substrates 26 are suitably prepared they are mounted onto the pallet 22, which is then mounted to the hoist 18. FIG. 2 and FIG. 3 illustrates how the pallet 22 is configured to hold the disk substrates 26. The dimension of the pallet, in the embodiment shown in the figures is approximately 18.25 inches by 16.75 inches. The pallet 22 is configured to hold twenty four disk substrates 26 as shown in FIGS. 5 and 6. The pallet 22 has openings 24. Each opening is approximately 2 3/8 inches in diameter and as shown in FIG. 2, each opening 24 is configured to provide two supporting means 54, with grooves 58, for supporting a disk substrate at its outer circumferential edge. Each supporting means 54 extends radially inward approximately 0.3 inches into the opening 24. Each disk substrate 26 rests, at its outer circumferential edge 56, in the grooves 58 of the two supporting means 54. The supporting means are coated with an electrically non-conducting material except at the inner surface of the groove. The disk substrates 26 are resiliently urged into the grooves 58 by the action of a biasing arrangement 60. In this embodiment, the biasing arrangement 60 is a spring made of an electrically non-conductive material that applies downward biasing force to the disk substrates 26 thereby holding each disk substrate 26 by its outer circumferential edge 56 in the opening 24 of the pallet 22. The pair of springs 60 are shown attached to the pallet 22 with screws 72 (see FIG. 2). In this embodiment the springs 60 are made of plastic but other nonconducting materials might be used. The springs 60 don't plate-up during the electroplating operation because they are made of electrically non-conducting or insulating material, thereby reducing maintenance and strip cycles while making it easier to adopt an automated substrate loading and unloading system. Leaf springs may be used as an alternative in the biasing arrangement. Alternative shapes for the supporting means are shown in FIGS. 3b and 3c.

During operation of the plating line 5 shown in FIG. 1, the pallet 22 is transported, by the hoist 18, from station to station for cleaning, rinsing, activation and finally deposition of magnetic material onto the disk substrates 26. The metallized layer of the disk substrate 26 must be adequately cleaned and activated prior to the permalloy (NiFe) plating step. Disk substrates 26 are loaded onto the plating pallet 22 and are then transported through each of preparation and electroplating steps.

The pallet 22 with disk substrates 26 mounted on it is first immersed into the liquid bath of the cleaning station 12. At the cleaning station 12 the non-magnetic nickel-phosphorous (NiP) layer of the disk substrate 26 is cleaned. In this embodiment the disk substrates 26 are cleaned using a hot soak metal cleaner, such as Enthone Alprep 204, heated to 130°-150° F., with anodic assistance (approximately 5-10 amps per square foot average at the disk substrate which is anodic, or at a positive electrical potential) for 1-3 minutes approximately. Good electroplating results have been obtained by using the above mentioned parameters for the cleaning process.

The pallet 22 is then transported to the rinse station 10 where the disk substrates 26 are subjected to a deionized water rinse to fully wet the disk substrates 26. Depending on the nature and degree of the contamination, it may be useful to use various other rinses or cleaning methods to adequately clean the metal surface of the disk substrate 26.

From the rinse station 10 the pallet 22 is next transported to the activation station 14 where the fully wetted parts are de-oxidized. For activation of the cleaned nickel phosphorous (NiP) surfaces, good results have been obtained by using a dilute sulfuric acid (approximately 3-10%) at ambient temperature, with cathodic assistance (5-10 amps per square foot average at the substrate, which is cathodic, or at a negative electrical potential) for 0.5-2 minutes approximately. Activation steps may also widely vary in acid strengths, activation times, and electrical potential levels, based on the metal alloy to be plated and the degree and type of surface oxidation. Following the activation step the disk substrates 26 are ready for electro-deposition in the bath of the plating station 16.

The pallet 22, with the disk substrates 26, are next transported to the plating station 16. The plating station 16 consists of a tank in which is mounted a plating cell 62. As shown in FIG. 4, 4*a*, and 5, plating cell 62 consists of two identical side walls 38, mounted on a bottom diffuser plate 40, aligned with each other. As shown plating station 16 that can accommodate 8 plating cells 62. Since each pallet 22 holds twenty four (24) disk substrates 26, the number of disk substrates 26 that can be electroplated simultaneously is 192. By designing a larger plating station 16 to accommodate more plating cells 62 the number of disk substrates that can be simultaneously plated may be increased. Additionally, the plating cell 62 may also be scaled up to allow more disk substrates 26 to be processed per plating cell.

The hoist 18 is used to lower the pallet 22 into a plating cell 62 between the two side walls 38 of the cell 62. When fully lowered the disk substrates 26 must be completely submerged within the plating liquid 64 in the plating cell 62. Each side wall 38 is made of an electrically non-conducting material, such as polypropylene. The dimensions of the side walls 38 used in this embodiment are 21 inches by 14.5 inches. When the pallet 22 is brought to rest in plating cell 62, each substrate 26 is aligned with a magnet 44, extending from the side walls 38, along an individual central transverse axis 69 (see FIG. 7). The pallet 22 is of a composite construction, that is, the interior of the pallet 22 is made of an electrically conductive material. Good results have been obtained by using a metal, such as titanium. The exterior of the pallet 22 is formed with an electrically insulating material, for example a non-conducting plastic such as polyvinylidene fluoride (PVDF).

The interior of the pallet 22 is electrically connected to the negative pole of a plating power supply 37. There exists, therefore, a conductive path for electric current between the plating power supply 37 and the disk substrates 26 through the substrate metal of the pallet 22. The disk substrates 26 serve as cathodes during the electroplating process.

The anodes 36 in the embodiment shown in the figures are made of nickel and iron and are soluble when electrically energized during electroplating. In the present invention, the preferred embodiment has anodes 36 that are square in shape, each side being 2¼ inches. Circular anodes, 2¼ inches in diameter have also been used with good results. Anodes 36 made of other conventional materials can be used depending on the deposit requirements of the disk substrate 26. Each of the anodes 36 are electrically connected to the positive pole of the plating power supply 37, through metal contacts 32 as shown in FIG. 4. The contacts 32 are made of titanium in this embodiment and are inserted through a collar 30 as shown in FIG. 4 and 5.

The plating power supply 37 used in this embodiment consists of two banks of 24-channel current regulators thereby regulating each of the 48 anodes 36 in the plating cell 62 individually. The plating power supply 37 is driven by a ripple free constant voltage source and designed to the following specifications:

Output Voltage: 1.25-40V
Line Regulation: 0.01%/V
Load Regulation: 0.1% at 1.5A
Minimum Load Current: 3.5 mA
Temperature Stability: 0.01% /□C
Maximum Current: 2.2A
Ripple Rejection: 80 db The plating station 16 contains an electrolyte, also referred to as the plating solution 64, a nickel and iron compound in this embodiment, that acts as a source of ions for the replenishment of ions at the disk substrate 26. Good results have been obtained using a plating solution 64 that has the following components and concentrations:

Total Nickel content: 6 to 9 oz/gal,
Total Chloride content: 1.5 to 4.5 oz/gal,
Nickel Sulphate: 16 to 32 oz/gal,
Nickel Chloride: 6 to 10 oz/gal,
Boric Acid: 5.5 to 7.5 oz/gal,
Total Iron: 0.5 to 1.0 oz/gal,
Ferric Iron: not to exceed 25% of total iron, and not to exceed 1 gram/liter,
pH 2.8 to 3.6
Temperature: 130° to 140° F.

In addition, suitable additives, that are commercially available maybe added to control plating solution surface tension, deposit levelling and stress.

The plating solution 64 surrounds the anode 32, the magnet 44 and the substrates 26 on the pallet 22 and facilitates the movement of metal ions between disk substrate 26 that serve as the cathode and the anode 36. During electroplating of the permalloy material, the plating power supply 37 energizes the cathode 26 and the anode 36. When electrically energized, an oxidation reaction occurs at the anode surface 36, whereby the metal in the anode 36 is oxidized to generate metal ions. The electric current supplied to each anode 36 is individually controlled by adjustable current regulators in the plating power supply 37, thereby allowing control of current distribution throughout the plating cell 62. The anode 36 dissolves and discharges positively charged nickel ($Ni^{++}$) and iron ($Fe^{++}$) ions into the plating solution 64. As the anode 36 dissolves and discharges positively charged nickel and iron ions into the plating solution 64, the ions travel through the solution 64 towards the negatively biased disk substrate 26 and are deposited on the surface of disk substrate 26. At the disk substrate surface 26, the nickel and iron ions are reduced, with electrons supplied to the cathode 22 from the negative pole of the plating power supply 37 ($Ni^{+++}+2e \rightarrow Ni$, $Fe^{+++}+2e \rightarrow Fe$), and result in a magnetic deposit on the disk substrate surface 26.

Further, each disk substrate 26, has a pair of magnets 44 each projecting from side wall 38 to terminate facing each other at a central region of each disk substrate 26, one on each side. The magnets 44 are placed inside the plating cell 62 to provide localized magnetic fields. The magnets 44 project from the side wall 38, through opening 42 of anode 26 into the central region of the plating cell 62. Each magnet 44 is attached to inside surface 29 of side wall 38 at opening 34 in the side wall as shown in FIG. 4. Permanent magnets, such as the magnets 44, are used in this embodiment to provide magnetic fields for the orientation of the material forming the permalloy layer on the disk substrates 26. Good results have been obtained by using cylindrical Alnico 8 permanent magnets 44, that are 1.5 inches long and 0.5 inches in diameter. Other magnet types may also be used but Alnico 8 was found to be the most appropriate magnet type for the temperature and environment of the plating cell, as well as being cost effective for commercial purposes.

Figure 9:
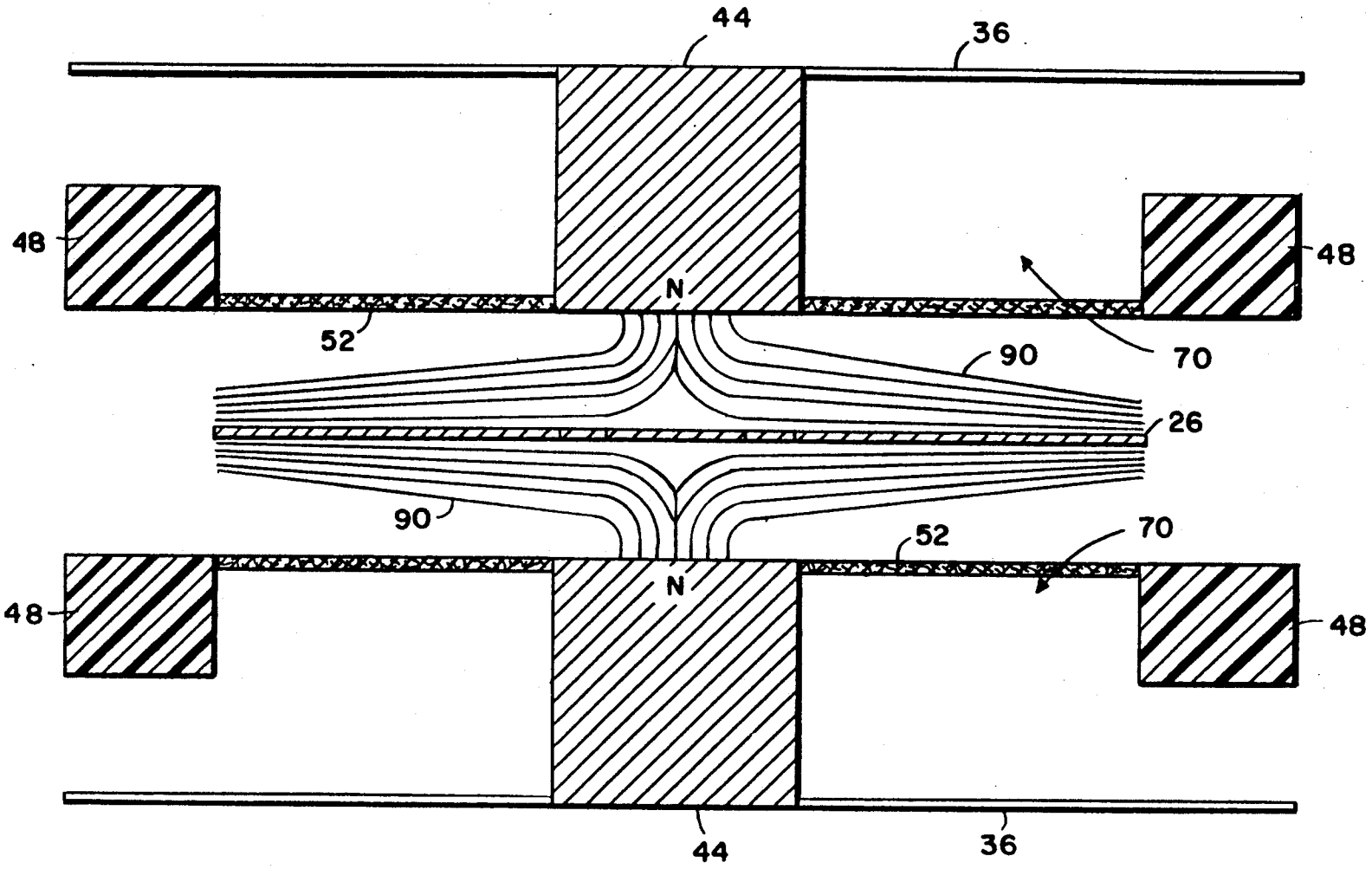
FIG. 9 is a cross-section view of a section of the plating cell indicating the magnetic field generated by the magnets across the surface of the disk substrate.

The magnets 44 are arranged such that like poles face each other while opposite poles are adjacent to each other, as shown in FIG. 9. This results in a radial magnetic field 90, that is centered at the center of the disk substrate 26 and extends towards the outer edge of disk substrate 26 as shown in FIG. 9. When the magnetic material is deposited on the disk substrate 26 in the presence of a magnetic field, an easy axis is induced in the direction of this field. The magnetic orientation of the deposited material results in greater magnetic permeability in the preferred circumferential direction than in the radial direction. Magnetic field strength decreases as the inverse square of the distance from the pole of a magnet. The invention takes advantage of this fact by placing the cylindrical permanent magnets 44 in close proximity to the disk substrate surface 26 to achieve high field strength at the disk substrate surface 26. Utilizing anodes 36 with openings 42 through which magnets 44 extend into the chamber of the plating cell 62, allows a magnet's pole to be in close proximity to the center of disk substrate 26 on each side.

Further, the field strength rapidly decreases across the disk surface in a radial direction from the center outward as shown in FIG. 9. This allows local control of magnetic flux energy for each disk substrate 26 with minimal interaction between magnetic fields of neighboring magnets. Consequently, the invention is able to electroplate a large number of disk substrates 26 simultaneously by minimizing the space requirement between disk substrates 26 on the pallet 22, while avoiding magnetic field interference.

Using more powerful magnets than the one used in this embodiment would result in better uniformity of magnetic flux energy across the surface of the disk substrate, but would require the disk substrates 26 to be placed further apart to provide adequate control of interference from magnetic fields of neighboring magnets. Although the magnets 44 used in this embodiment are permanent magnets, electromagnets can also be used. The permanent magnets 44 help to simplify the system and to keep the costs low. The proper orientation of the magnetic material on the surfaces of disk substrate 26 requires a radially oriented magnetic field of a minimum of 25 gauss. The strength of the magnetic field may be anywhere from 25 gauss to many hundreds of gauss.

Figure 8:
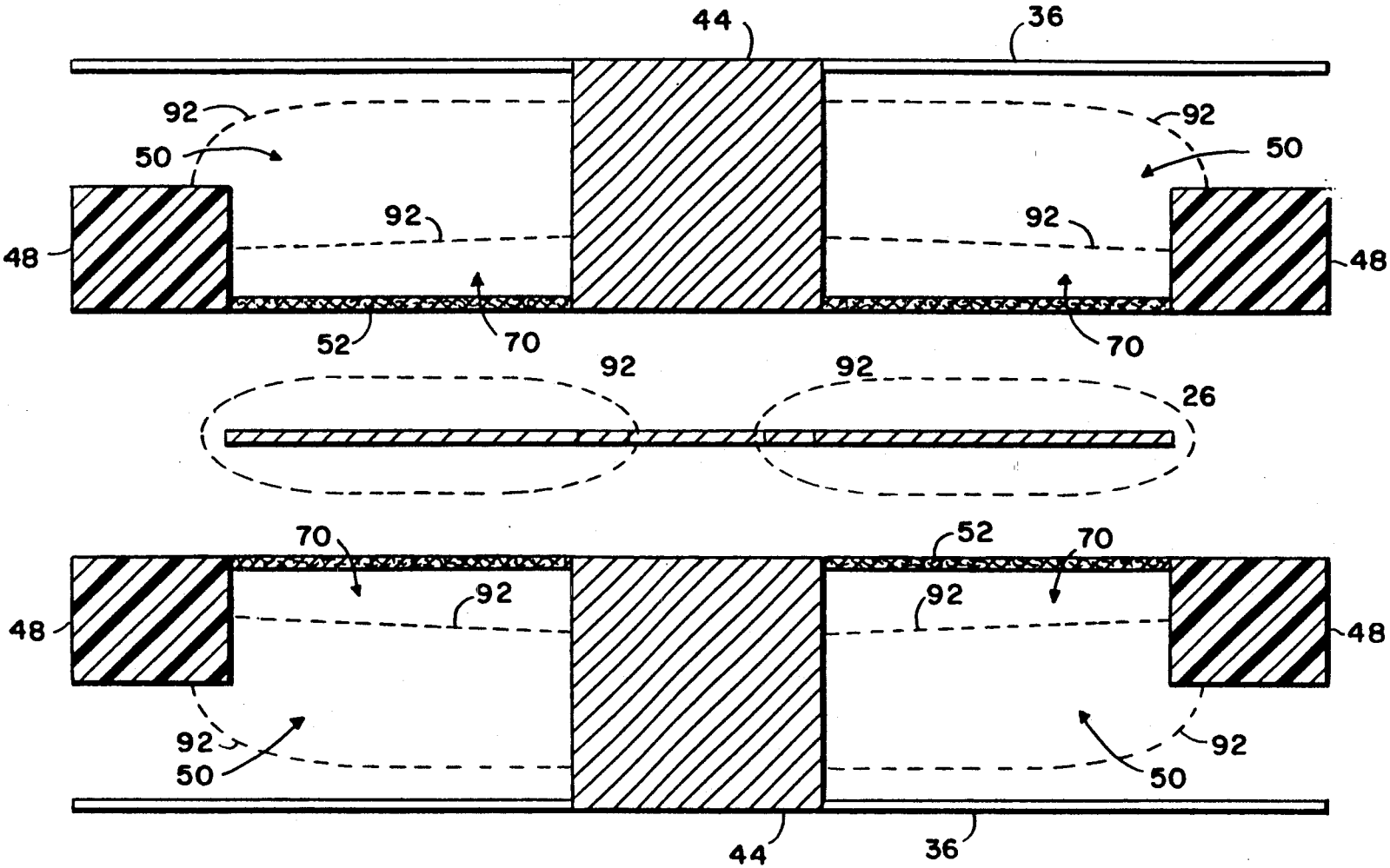
FIG. 8 is a vertical cross-section view of a section of the plating cell indicating lines of equal ohmic potential across the surface of the disk substrate.

One of the primary factors influencing plating distribution is the distribution of current across the surface of the disk substrate to be plated. If current distribution is uniform, plating distribution is uniform. Current distribution can be made uniform by establishing uniform ohmic potential across the surface of the disk substrate 26 as shown in FIG. 8. This invention uses insulators acting as current shields to control the uniformity of ohmic potential across the entire disk substrate surface as shown in FIG. 8, by the lines of equal ohmic potential 92.

The magnets 44 are coated with an insulation material 66. This allows the magnet 44 to function as a current shield as well. By choosing an appropriate magnet 44 geometry and a suitable insulating coating 66, magnet 44 is used not only to provide flux energy but also to improve the current flow to the inner diameter region of the disk substrate 26 by acting as an insulator and thereby controlling the resistive paths in the plating cell 62.

In addition to the current shielding resulting from the insulated magnet 44, a shield 48 is utilized to further control current flow in the plating cell 62. Shield 48 has openings 50 and is made of a non-conductive material. In the preferred embodiment the size of shield 48 used is 19 inches by 13 inches with 1.3 inch diameter openings, and is made of CPVC plastic. The number of openings in each shield 48 is equal to the number of openings 24 in pallet 22. Shield 48 is placed in plating cell 62 between side wall 38 and pallet 22 as shown in FIG. 4 and 5. The shield 48 functions as a current shield allowing current flow only in the 'donut shaped region' 70 between the openings 50 in the shield 48 and around the insulated magnets 44, because electrical current takes the path of least resistance, and the donut shaped region 70 provides the path of least resistance in the cell 62.

The size of the donut shaped region can be controlled by adjusting the size of the magnet 44 and the size of the opening 50 on the shield 48. The effective size of the insulator 44 (i.e. the magnet 44) can be controlled with the use of slip-on insulator rings 68. Adding insulator rings 68 to the magnet 44 increases the diameter of the insulator 44 and thereby decreases the plating thickness at the inner diameter region of disk substrate 26. The multi-function magnet design eliminates the typical high-current edge effect as would be expected without the current shielding effect brought about by insulated magnet 44. Further, the shield 50 helps to direct current flow in such a fashion as to eliminate the high current edge effects at the disk substrate 26 outer diameter region. This allows for control of the plating thickness at the outer diameter of the disk substrate 26 thereby promoting uniformity of plating at the outer edges of the disk substrate 26. The smaller the opening 50, the lower the thickness at the outer diameter of the disk substrate 26, while the larger the opening 50, the higher the plating thickness at the outer diameter of the disk substrate 26.

Plating thickness is controlled by regulating the current flow within the plating cell 62. While plating thickness at the outer and inner diameter regions of the substrate 26 is controlled by varying the size of the shield opening 50 and the size of the magnet 44, the plating thickness across rest of the substrate surface 26 can be controlled by changing the size of the doughnut shaped region 70 formed between the opening 50 in the shield 48 and the magnet 44. The size of the doughnut shape region 70 can be controlled by varying the size of the openings 50 in the shield 48 and by the selective use of slip-on insulator rings 68 on the magnet 44.

Due to the unique geometry of the anode 36 and magnet 44 configuration, conventional anode bags for the anode 36 cannot be used. Therefore, this invention uses a sub-micron membrane filter 52 that is attached to a surface of the shield 48. The membrane 52 integrates with the shield 48 to act as a filter to help contain anode particles and sludge from reaching the cathode 22, thereby protecting the cathode 22 from unwanted impurities and also controlling the quality of the deposit on the substrate 26. In this embodiment the filter used is a sub-micron rated polypropylene membrane. Other suitable filter material constructed of chemically compatible material and particle rated as appropriate for the application may be used instead.

It is also very important that a relatively consistent flow of plating solution 64 be maintained within the plating cell 62 to minimize process variability. In order to achieve a high level of plating uniformity and uniformity of deposit concentration, a uniform solution flow must be maintained around each disk substrate 26.

As more clearly shown in FIGS. *6a*, *6b*, *6c* and *6d* a mechanism to provide circular oscillatory motion to the pallet 22 is used to provide improved plating solution flow distribution around disk substrates 26 while maintaining disk substrates 26 each centered to the shields 48 and magnets 44. FIG. *6a* demonstrates the mechanism 88 used to provide circular oscillation to the pallet 22. The mechanism includes a motor 74 that drives pulley 76 which is connected through a belt 80 to two drive pulleys 77. The two drive pulleys 76 are connected to a tooling plate 78 that is connected to the pallet 22 through a cam linkage 99 as shown in FIG. *6d*. The motor 74 provides circular oscillating motion to pulley 77 which in turn transmits that motion through the belt 80 to the two drive pulleys 76. The circular oscillatory motion of the drive pulleys 76 is transmitted to the pallet 22 through a cam link arrangement 99. As shown in FIG. *6d*, a shaft 94 mechanically connects the center of each drive pulley 76 with the cam 95 at recess 100 through bearing 97 pressed into the cam 95. A linkage pin 96 in the cam 95 connects to a bearing in the tooling plate 78. The linkage pin 96 attaches to the cam 95 at one of several recesses 98. By selecting a recess 98 the radius of circular oscillatory motion imparted to the pallet 22 may be controlled.

The circular oscillation method allows us to maintain equivalent variation of flux field and current around the substrate 26 surface during electroplating, while providing controlled plating solution 64 flow at the substrate 22 surface. The oscillation mechanism 88 is attached to the pallet 22 after the pallet is placed inside the plating cell 62 by the work bar 20. The oscillation mechanism 88 may be built into the work bar 20 instead.

The following components were used to generate oscillatory motion for the embodiment shown in FIG. 6.:

Drive Motor: Servo (an equivalent variable speed bidirectional drive may be used)
Drive Pulley: ½" Pitch Timing Belt
Drive Ratio: 2.33:1
Motor Speed: 0–5000 rpm (maximum)
Acceleration: Continuously Adjustable
Motor Stall Torque: 5.0 in-lb
Oscillation Offset Radius: 0.15", 0.175", 0.2"
Oscillation Rotational Freedom: Uninhibited (360° degrees, single plain).

To further ensure uniform plating distribution from substrate to substrate and from side to side of each substrate 26, within the plating cell 62, a segmented anode 36 configuration has been used as shown in FIG. 5. A separate anode 36 is used for each side of each substrate 26 to allow localized current regulation around each substrate 26 during electroplating.

The effectiveness and efficiency of the plating cell 62 is largely dependent on geometrical tolerances of the various members in the cell 62. The radial magnetic flux energy across the substrate 26 surface is greatly influenced by the spacing between the magnet 44 faces across the cell 62 and also by the distance between adjacent magnet 44 pairs. The closer the magnet 44 faces are positioned to the cell 62 centerline, the higher the flux energy from the magnet 44. Therefore positioning the magnets 44 close to the center allows smaller and less expensive magnets 44 to be used. Also, the closer the magnet 44 faces, the lesser the bending of the radial centerline, thereby allowing increased density of substrates 26 on a given sized pallet 22.

The distance from the cathode 22 to the shield 48 effects the size requirement of the doughnut shaped primary current path 70. The closer the shield 48 is to the cathode 22, the larger the path 70 may become while maintaining acceptable current distribution. Similarly, the path 70 may become smaller when the shield 48 is placed further away from the cathode 22. The narrower the plating cell 62, the more space efficient and energy efficient the system becomes. Less surface area within the cell 62 requires less exhaust, while less spacing between anode 36 and cathode 22 requires lower driving voltage with a given conductivity solution 64.

The plating cell 62 could be configured in a variety of sizes. The embodiment described herein may be re-sized to process much larger or much smaller loads of substrates 26, and could be modified to process substrates 26 of other sizes, either smaller or larger. The system is most efficient with smaller format substrates 26.

The method and apparatus that is described above was used to electrodeposit a soft magnetic material such as permalloy onto disk substrates. It will be apparent to those skilled in the art that various modifications and variations can be made in the apparatus and method of the present invention to electrodeposit other types of magnetic material, both hard and soft, onto disk substrates. Thus, it is intended that the specification and drawings be considered as exemplary only, with the true scope and spirit of the invention being indicated by the following claims.

What is claimed is:

1. An apparatus for electroplating substrates comprising:

a holder for mounting substrates thereon;

means for oscillating the holder when the holder is placed in an electroplating tank to electroplate substrates, said means for oscillating comprising pulleys;

a belt mounted on the pulleys thereby linking the pulleys;

a motor, wherein the motor rotatably moves one of the pulleys such that the rotary motion of the one pulley is transferred to other pulleys through the belt mounted thereon;

a tooling plate, wherein said tooling plate is attached to the holder and to pulleys other than the one pulley that is rotated by the motor, said tooling plate being rotatably moved when the pulleys are rotatably moved.

2. The apparatus of claim 1 wherein the motor is a variable speed bi-directional motor.

3. An apparatus for providing oscillatory motion for a plating system for substrates comprising:

pulleys;

a belt mounted on the pulleys thereby linking the pulleys;

a motor, wherein the motor rotatably moves one of the pulleys such that the rotary motion of the one pulley is transferred to other pulleys through the belt mounted thereon;

a tooling plate, wherein said tooling plate is attached to pulleys other than the one pulley that is rotated by the motor, said tooling plate being rotatably moved when the pulleys are rotatably moved;

a holder for mounting substrates, said holder being attached to the tooling plate wherein the holder rotatably moves when the tooling plate moves when placed in an electroplating tank to electroplate substrates.

4. An electroplating apparatus comprising:

a holder having an opening, said holder comprising an electrically conductive interior and a non-conducting exterior, means for holding a member to be electroplated at the opening of the holder;

an electrical connection between the interior of the holder and the member held at the opening thereof so that when the interior of the holder is electrically energized and the holder is immersed in an electroplating liquid during electroplating the member functions as a cathode;

an anode in spaced apart relationship with the holder, the anode having an opening aligned with the opening in the disk holder;

an electrical energy source connected to the holder for electrically energizing the interior of the holder with a negative charge and connected to the anode for electrically energizing the anode with a positive charge;

an electrically non-conducting shield mounted in spaced apart relation between the holder and the anode, such shield having an opening therethrough;

a magnet extending through the opening in the anode;

a filter covering the opening in the shield effective to remove unwanted matter from electroplating liquid passing therethrough;

means for providing oscillatory motion to the holder with member held thereon so that when the holder is immersed in an electroplating bath during electroplating plating liquid flow around the member is uniform.

* * * * *